US008105051B2

(12) United States Patent
Kusay et al.

(10) Patent No.: US 8,105,051 B2
(45) Date of Patent: Jan. 31, 2012

(54) VACUUM PUMP

(75) Inventors: Roland Gregor Paul Kusay, Redhill (GB); Clive Marcus Lloyd Tunna, Bolney (GB)

(73) Assignee: Edwards Limited, Crawley, West Sussex (GB)

( * ) Notice: Subject to any disclaimer, the term of this patent is extended or adjusted under 35 U.S.C. 154(b) by 1385 days.

(21) Appl. No.: 11/629,650

(22) PCT Filed: Jun. 13, 2005

(86) PCT No.: PCT/GB2005/002329

§ 371 (c)(1),
(2), (4) Date: Dec. 15, 2006

(87) PCT Pub. No.: WO2005/123195

PCT Pub. Date: Dec. 29, 2005

(65) Prior Publication Data

US 2007/0183909 A1 Aug. 9, 2007

(30) Foreign Application Priority Data

Jun. 18, 2004 (GB) ..... 0413776.6

(51) Int. Cl.
*F04B 49/00* (2006.01)

(52) U.S. Cl. ..... 417/282; 417/410.4

(58) Field of Classification Search ..... 417/410.4, 417/410.3, 19, 279, 282
See application file for complete search history.

(56) References Cited

U.S. PATENT DOCUMENTS

| | | | | |
|---|---|---|---|---|
| 5,066,202 | A * | 11/1991 | Berges et al. | 417/228 |
| 5,752,812 | A | 5/1998 | Brown | |
| 6,202,667 | B1 | 3/2001 | Chen | |
| 6,715,338 | B1 * | 4/2004 | Hsu | 73/23.2 |
| 2002/0040940 | A1 | 4/2002 | Wagner et al. | |
| 2002/0149297 | A1 * | 10/2002 | Yamamoto et al. | 310/328 |
| 2003/0010000 | A1 | 1/2003 | Hamilton et al. | |

FOREIGN PATENT DOCUMENTS

| | | |
|---|---|---|
| EP | 0 314 133 B1 | 5/1989 |
| EP | 0 836 007 A1 | 4/1998 |
| EP | 1 039 187 B1 | 4/2005 |
| JP | 2003-120529 | 4/2003 |

OTHER PUBLICATIONS

JP DeGabriel, JC LeGrand, C. Lombard, B. Canivet; Abstract of EP 0 836 007 A, "Vane Vacuum Pumps or Compressors," Apr. 15, 1998; ELF Atochem SA; MPRI Machines Pneumatiques Rotatives IND.
Ishigure Hiroyuki, Yamamoto Shinya, Kawaguchi Masahiro; Abstract of JP 2003120529 A, "Gas Feeder in Vacuum Pump," Apr. 23, 2003; Toyota Ind Corp.

(Continued)

*Primary Examiner* — Devon C Kramer
*Assistant Examiner* — Peter J Bertheaud

(57) ABSTRACT

A method of inhibiting combustion within a vacuum pump is provided. The method steps include monitoring and composition of a fluid within the pump and supplying purge gas to the pump to inhibit the onset of a combustion of the fluid. There is also provided a pumping arrangement comprising a vacuum pump (1) together with means (8) for supplying purge gas to the pump. Sensor means (21*a*, 21*b*, 21*c*) are provided for outputting a signal indicative of the onset of a combustion condition within the pump. Control means (22) receive the signal and, in turn, actuate the supply means (9) dependant on the signal received.

25 Claims, 2 Drawing Sheets

OTHER PUBLICATIONS

Tyler Aebersold, Keith Goodall, "Inert Gas Extinguishing Systems—The Next Generation," Fire Safety Engineering, Paramount Publishing Ltd., vol. 10, No. 5, Sep. 2003, pp. 24-26.

United Kingdom Search Report of Application No. GB 0413776.6 dated Sep. 28, 2004; Claims searched: 1-23; Date of search: Sep. 27, 2004.

PCT Notification of Transmittal of the International Search Report and the Written Opinion of the International Searching Authority, or the Declaration of International Application No. PCT/GB2005/002329; Date of mailing: Sep. 2, 2005.

PCT International Search Report of International Application No. PCT/GB2005/002329; Date of mailing of International Search Report: Sep. 2, 2005.

PCT Written Opinion of the International Searching Authority of International Application No. PCT/GB2005/002329; Date of mailing: Sep. 2, 2005.

* cited by examiner

VACUUM PUMP

FIELD OF THE INVENTION

This invention relates to the field of vacuum pumps, in particular those pumping flammable mixtures.

BACKGROUND OF THE INVENTION

Chemical, pharmaceutical and semiconductor processes are typically performed in a process chamber under vacuum conditions. The process chamber is evacuated by a vacuum pump of appropriate capacity. Such a vacuum pump may for example be a single stage booster or multi stage pump of Roots or Northey ("claw" type) configuration, alternatively the pumping mechanism may have a single or multi stage screw mechanism.

Many of the above processes use or generate potentially flammable mixtures containing a fuel such as an organic solvent, hydrogen or silane. The pumping of such mixtures requires great care to be placed on the leak integrity of the foreline and exhaust lines from the pump to ensure that there is no ingress of air into the lines which could create a flammable atmosphere. Moreover, in some processes a fuel and an oxidant, for example TEOS (tetraethoxysilane) and ozone, may flow through the pump at the same time. In such circumstances any hot spots within the pump could provide intermittent ignition sources for the fuel, which could result in the generation of hazardous flame fronts travelling through the pump into the exhaust lines, or, where explosion pressures are sufficiently high, into the process chamber.

Management of risks associated with such potentially hazardous installations are governed by industry Standards. Different classifications of risk can be specified by these Standards, each class requiring different levels of subsidiary safety devices, instrumentation and or controls to be employed in order to mitigate the different perceived levels of risk associated with that particular class. Equipment may be given a higher classification due to potential risk that may in practical terms be rarely achieved. This additional mitigation equipment may only be actively utilised during exceptional, hazardous circumstances, being effectively redundant during normal operation of the pump. Such redundancy, in many applications, can be detrimental to the overall capacity of the pumping apparatus either due to the cost of, or additional space required to accommodate, such redundant equipment. It is, therefore, desirable to provide alternative mitigation techniques that minimise the costs and footprint of such mitigation equipment. One example of such mitigation equipment is a flame arrester, which causes a significant pressure drop in the fluid passing therethrough. When such a flame arrester is placed at the inlet of the pump, i.e. in a region that is particularly sensitive to such pressure drops, the pumping performance of the vacuum pump can be significantly affected.

SUMMARY OF THE INVENTION

According to a first aspect of the present invention there is provided a method of inhibiting combustion within a vacuum pump of a pumping arrangement, the method comprising the steps of monitoring the composition of a fluid within the pumping arrangement; and depending on the monitored composition, supplying gas to the pumping arrangement to inhibit the onset of a combustion condition, such as the presence of a flammable atmosphere, within the pump.

The gas supplied to the pumping arrangement may be a purge gas or it may be a fuel gas.

The amount of flammable fluid or oxygen within the pumped fluid may be monitored and if this value exceeds a predetermined value the gas supply may be initiated. Alternatively, the monitored parameter may be the ratio of flammable fluid to oxidant within the pumped fluid and the supply of gas to the pump may be initiated if this parameter exceeds a predetermined value. This predetermined value may be at or below the lower explosive limit of the flammable fluid.

The relevant parameter may be monitored in the exhaust region of the pumping arrangement, for example in the exhaust region of the pump or within the exhaust line. Alternatively or additionally, the parameter may be monitored in the foreline or within the swept volume of the pump. The monitoring step may be undertaken by a sensor and the monitoring could occur either periodically or continuously. The gas may be supplied into one of the foreline, the swept volume of the pump and the exhaust line of the pumping arrangement, or any combination thereof. Gas may be supplied for a predetermined period of time or it may be supplied for a time dependent on the monitored parameter. If the monitored parameter remains in excess of the predetermined value for a predetermined period of time, the pump may be isolated from the process chamber.

Such monitoring of the composition of the fluid within a vacuum pumping arrangement may be combined with other techniques for inhibiting combustion. Therefore, according to a second aspect of the present invention there is provided a method of inhibiting combustion within a vacuum pumping arrangement, the method comprising the steps of: monitoring the composition of a fluid within the pumping arrangement; and, depending on the monitored composition, inhibiting the escalation of a combustion condition, such as the build up of flammable fluid, within the pumping arrangement.

The escalation of the combustion condition may be inhibited by switching off a pump within the pumping arrangement or it may be inhibited by providing a flame arrester element within the pumping arrangement. Preferably, the escalation of the combustion condition may be inhibited by supplying a gas to the pumping arrangement.

According to a third aspect of the present invention there is provided a pumping arrangement comprising a vacuum pump; means for monitoring the composition of a fluid within the pumping arrangement; means for inhibiting the escalation of a combustion condition within the pumping arrangement; and control means for receiving a signal from the monitoring means and for actuating the inhibiting means in dependence on the signal.

The inhibiting means may be configured to switch off the vacuum pump in response to the signal. The inhibiting means may be provided by a flame arrester component. The flame arrester component may be a retractable flame arrester and it may be located in one or more of a foreline or an exhaust line of the vacuum pump. Alternatively, the flame arrester component may be located in a bypass line, the bypass line being selectably connected to a foreline and/or an exhaust line of the vacuum pump.

According to another aspect of the present invention there is provided a pumping arrangement comprising a vacuum pump; means for supplying gas to the pumping arrangement; means for outputting a signal indicative of the onset of a combustion condition within the pumping arrangement; and control means for receiving the signal and for actuating the supply means in dependence on the signal.

The outputting means may be provided by a sensor which may be located in the inlet and/or the exhaust region of the pump. The or each, sensor may be an oxygen depletion detector such as an oxygen partial pressure sensor or it may be a flammable fluid detector such as a reactive sensor, a catalytic sensor or an infrared sensor.

In a preferred embodiment there is provided a method of inhibiting combustion within a vacuum pump of a pumping arrangement, the method comprising the steps of monitoring the composition of a fluid within the pump; and depending on the monitored composition, supplying purge gas to the pumping arrangement to inhibit the onset of a combustion condition within the pump. There is also provided a pumping arrangement comprising a vacuum pump; means for supplying purge gas to the pumping arrangement; sensor means for outputting a signal indicative of the onset of a combustion condition within the pump; and control means for receiving the signal and for actuating the supply means in dependence on the signal.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 1:
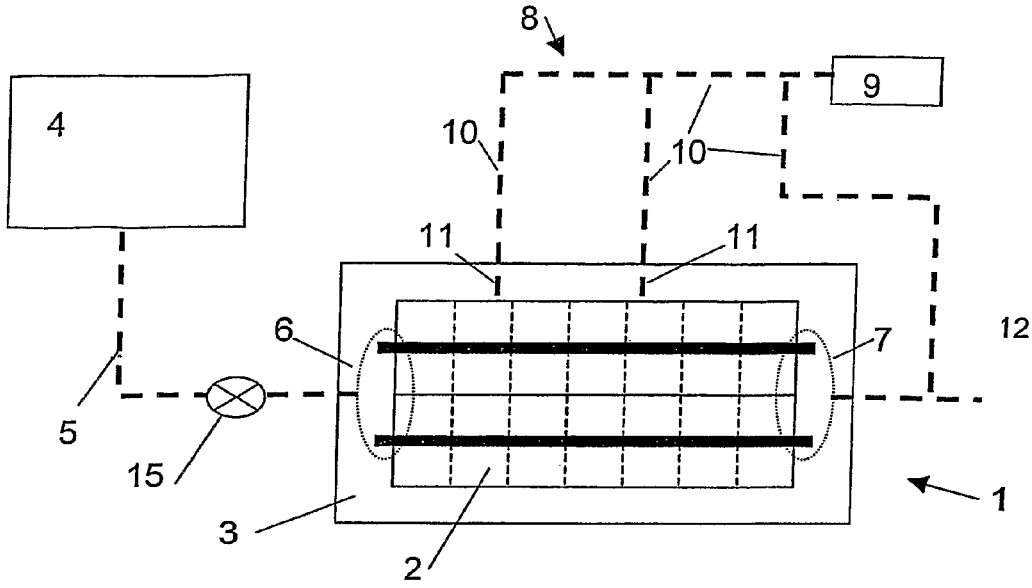
FIG. 1 is a schematic representation of a pump with a purge system.

A vacuum pump 1 typically comprises at least one rotor component 2 that acts cooperatively with a stator component 3 to displace process fluid (typically gaseous fluid) from a process chamber 4 located upstream of the pump 1. The process fluid is pumped through foreline 5 connected to an inlet 6 of the pump, through the swept volume of the pump, to an exhaust line 12 through an exhaust 7 of the pump 1.

In some circumstances the composition of the process gases is such that the pumped gas can become flammable. Such flammability, or combustibility, is dependent on the relative proportions of a fuel and an oxidant, for example oxygen, within the pumped gas. If the concentration of fuel within the pumped gas lies between certain limits, namely the upper and lower explosion limits (usually expressed as the percentage by volume in air) then combustion will take place if a source of ignition is present.

In one embodiment, the pumped gas is diluted with purge gas to inhibit the formation of any pockets of potentially combustible fluid within the process gas. In order to achieve this, a purge system 8 is provided to deliver purge gas such as nitrogen to the pump 1, typically down stream of an isolation valve 15 located in the pump foreline 5. Injection of such additional fluids, especially close to the inlet 6 of the pump 1, can affect the pressure in the process chamber 4. Such pressure fluctuations can, potentially, lead to backward migration of contaminating matter from the pump 1 to the chamber 4, hence the addition of any purge fluid must be carefully determined. Fluctuations in the inlet pressure will have a greater impact on the pumping performance than when the fluid is introduced down stream of the inlet. It is therefore desirable, where possible, to introduce fluid further downstream, towards the exhaust region 7 of the pump 1, in this way considerably less impact is seen at both the inlet 6 and the process chamber 4. Consequently, purge gas can more readily be introduced in the latter stages of the pump 1 without affecting the pumping capacity and the environment in the process chamber 4.

The purge system 8 comprises a purge gas supply 9 and conduits 10 connecting the gas supply 9 to the stator 3 at delivery ports 11 located along the length of the stator 3 to enable purge gas to be delivered directly to the swept volume and/or the exhaust region 7 of the pump 1.

Figure 2:
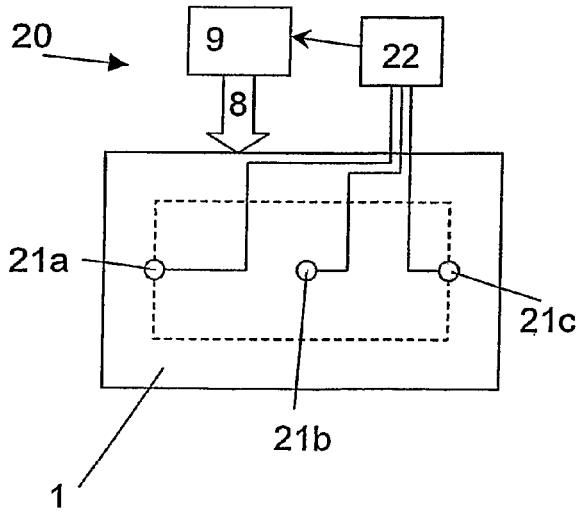
FIG. 2 is a schematic representation of an arrangement of sensors within the pump of FIG. 1.

FIG. 2 shows how the purge system 8 forms part of a dilution system 20. This dilution system 20 is able to assess the requirement for purge gas and control the delivery of this gas to the pump 1. The dilution system 20 includes at least one sensor 21 located within the swept volume and/or in the exhaust region of the pump 1 to detect the presence of a flammable gas mixture within the pumped gas. In practice, a plurality of sensors 21 may be provided (three sensors, 21*a*, 21*b*, 21*c* are shown in FIG. 2, although any number could be provided) to monitor the composition of the pumped gas within different regions of the pumping arrangement. These sensors 21*a*, 21*b*, 21*c* may be positioned at any suitable position within the swept volume, for example adjacent to the inlet 6, adjacent to part of the rotor 2 or adjacent the exhaust 7 of the pump, within the exhaust line 12 downstream of the pump 1 or even within the foreline 5 upstream of the pump 1.

These sensors 21*a*, 21*b*, 21*c* may be configured to monitor the composition of the pumped gas either continuously or at predetermined time intervals. The sensors may be in the form of reactive/catalytic or infrared sensors which detect the concentration of fuel with respect to other fluids present within the pumped gas. Alternatively the sensors may be oxygen partial pressure sensors which monitor oxygen depletion within the pumped gas.

The dilution system 20 also includes a controller 22 which receives signals from the sensors 21*a-c* indicative of a parameter that can be used to determine the likelihood of combustion occurring within the pump 1. In a simple example the sensors simply detect the presence of a flammable fuel within the pumped fluid. In a more complex example the sensors may be configured to detect the ratio of fuel to oxygen within the pumped fluid. The controller then compares this measured parameter with a predetermined value. In the simple case this may be simply to determine whether the amount of fuel exceeds a certain proportion, say 2%, of the pumped fluid. Where the parameter determined is the ratio of fuel to air, the predetermined value is typically the lower flammability limit of the fuel in question. If the relevant predetermined value is exceeded the controller will cause purge gas to be delivered to the pump 1 via delivery ports 11. This purge gas serves to dilute the pumped gas, causing any pockets of flammable mixture to be dispersed to minimise the risk of combustion within the pump 1. During introduction of the purge gas the composition of the pumped gas is monitored to ensure that any flammable fuel/oxygen mixture is sufficiently dispersed to prevent subsequent combustion. Once such a dispersed condition is achieved, the supply of purge gas may be stopped. Alternatively, it may be preferable simply to continue to dilute the pumped gases for at least a period of time, say 15 to 30 minutes, to allow any fuel present in the pumped gas to be fully dispersed and hence regarded as being at a safe level.

In some circumstances, such as an undetected fuel leak into the pumping system upstream of the pump 1, dilution may be insufficient to prevent combustion occurring within the pump 1. In these circumstances, the controller 22 may be configured to actuate the isolation valve 15 located in the foreline 5 of the pump 1. In this way, isolation of the pump 1 from the chamber 4 is initiated, whilst maintaining dilution of the pumped gases within the swept volume of the pump 1. In extreme circumstances, perhaps where the isolation valve 15 fails, the controller 22 may be configured to initiate shut down of the entire process and sound an alarm. In either instance, an operator may be notified so that the source of failure can be determined and rectified.

In an alternative embodiment, a fuel gas may be introduced into the pumping arrangement when a flammable composition is detected. The fuel gas subsequently mixes with the fluid present in the pumping arrangement which serves to increase the concentration, and hence the flammability, of the fluid mixture now present within the pumping arrangement. As a consequence, the concentration value rises above the upper flammability limit (UFL) such that combustion cannot occur because the mixture is too rich in fuel. In this way an explosion can be prevented. The fuel gas typically used to enrich the flammable atmosphere in the pump is methane, however other fuel gasses, such as propane or butane, may be used. Alternatively, in cases where the composition of the process gas is more predictable, the fuel gas can be matched to the flammable component of the process gas. Fuel gas is delivered to the pump 1 through delivery ports 11 in the same manner as the purge gas in the previous embodiment. In FIGS. 1 and 2, the gas supply 9 represents a source of fuel gas rather than purge gas and in FIG. 2 the system 20 represents an enrichment system rather than a dilution system.

Figure 3A:
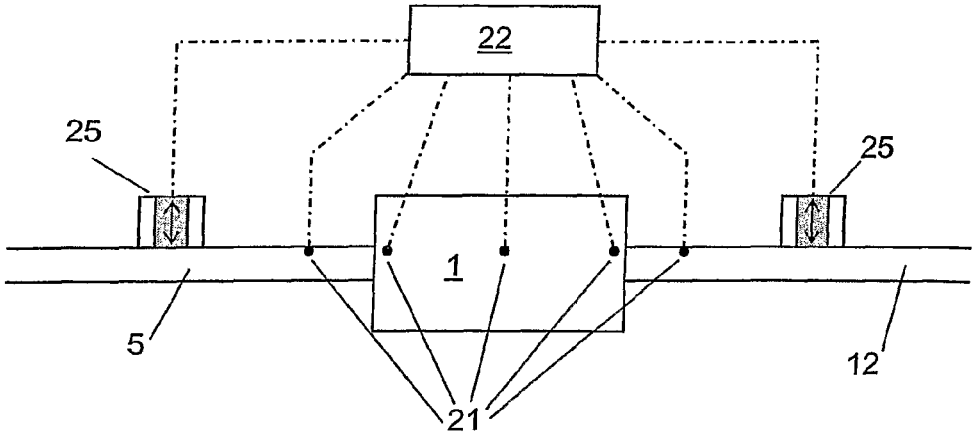
FIGS. 3*a* and 3*b* are schematic representations of pumping arrangements using flame arrester components.
Figure 3B:
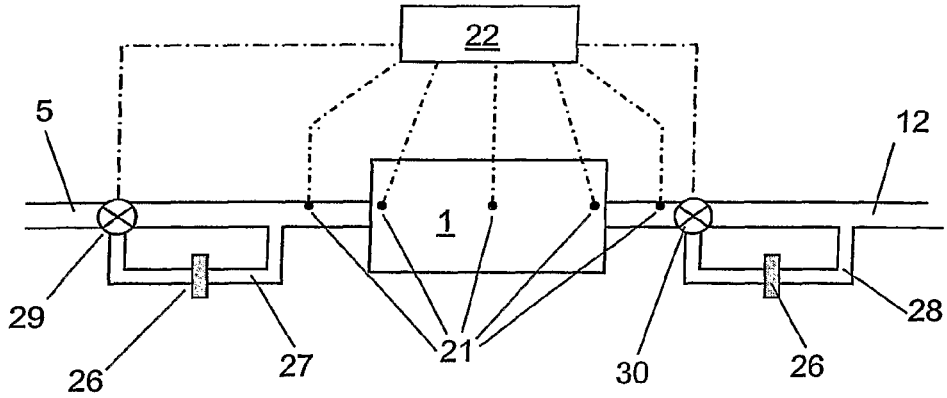

In some circumstances it may be inappropriate to supply purge gas or fuel gas to the pumping arrangement. In such cases the controller 22 can be configured to switch off the vacuum pump 1 upon detection of a flammable atmosphere therein, in order to prevent the situation from escalating. Alternatively, as illustrated in FIGS. 3*a* and 3*b*, flame arrester components 25, 26 may be provided in the pumping arrangement. FIG. 3*a* shows an arrangement where the flame arrester component is a retractable flame arrester 25, such as that described in EP1039187 the contents of which are incorporated herein by reference, in each of the foreline 5 and/or the exhaust line 12 of the vacuum pump 1. Upon detection of a flammable atmosphere within the pumping arrangement by sensors 21 the retractable flame arresters 25 can be actuated by the controller 22 such that they are moved from their retracted position (as shown) to their active position (not shown) within the ducting such that the pumped fluid must pass therethrough.

FIG. 3*b* shows an alternative arrangement where the flame arrester components 26 are permanently placed in each of two bypass ducts 27, 28. The bypass ducts 27, 28 are selectably connected to the foreline 5 and the exhaust line 12 respectively via three way valves 29, 30. Valves 29, 30 have two operating positions, a first position of each valve being in-line with its respective duct 5, 12 such that fluid can pass straight through, and a second position to divert the fluid into the respective bypass line 27, 28 such that the fluid is forced to pass through the flame arrester components 26. In normal operation of the pump 1 the process gas passes to and from the vacuum pump 1 using the foreline 5 and exhaust line 12 respectively. Upon detection of a flammable atmosphere by sensors 21 the three way valves 29, 30 can be actuated by controller 22 such that they cause the flow path to be defined through flame arrester components 26 at either end of the vacuum pump 1.

By implementing flame arrester components 25, 26 at either end of the pump 1 as described in relation to FIGS. 3*a* and 3*b* combustion within the pumping arrangement can be inhibited. If the flammable atmosphere present in the pumping arrangement were to be ignited the resulting flame would be unable to propagate beyond the location of the flame arrester components 25, 26, hence the explosion would be effectively mitigated.

The controller 22 may be used to monitor the number and duration of incidents where flammable gas is detected. This enables the controller 22 to assess the severity of conditions to which the pump is exposed. In particular, this data can be used to target the location and duration of the delivery of purge or fuel gas to the pump. For example, in severe conditions, purge or fuel gas may be constantly delivered at all delivery ports 11 including the inlet. Since introducing gas at the inlet 6 of the pump 1 may be more likely to cause pressure fluctuations upstream of the pump this is preferably avoided unless conditions are particularly severe. Where an inlet delivery of gas is used, it is desirable to carefully control both the flow rate and the duration to minimise any disturbance which may result as a consequence. In less severe conditions, gas delivery may be restricted to the exhaust region 7, 12 of the pump but more significant flow rates may be used.

Assessment, by the controller 22, of the conditions to which the pump 1 is exposed can be used to more clearly define the risks experienced by the pump 1 which may, in turn, enable a more accurate risk assessment and classification of particular apparatus to be undertaken.

While the foregoing description and drawings represent the preferred embodiments of the present invention, it will be apparent to those skilled in the art that various changes and modifications may be made therein without departing from the true spirit and scope of the present invention.

We claim:

1. A pumping arrangement comprising a vacuum pump:

means for monitoring the composition of a fluid within the pumping arrangement;

means for inhibiting the escalation of a combustion condition within the pumping arrangement; and control means for receiving a signal from the monitoring means and for actuating the inhibiting means dependant on the signal, wherein the means for monitoring comprises a sensor located within a swept volume of the vacuum pump.

2. The pumping arrangement according to claim 1 wherein the inhibiting means is configured to terminate operation of the pump in response to the signal.

3. The pumping arrangement according to claim 1 wherein the inhibiting means comprises a flame arrester component.

4. The pumping arrangement according to claim 3 wherein the flame arrester component is a retractable flame arrester.

5. The pumping arrangement according to claim 4 wherein the retractable flame arrester is selectably positioned in a foreline of the vacuum pump.

6. The pumping arrangement according to claim 4 wherein the retractable flame arrester is selectably positioned in an exhaust line of the vacuum pump.

7. The pumping arrangement according to claim 5 wherein a further retractable flame arrester is selectably positioned in an exhaust line of the vacuum pump.

8. The pumping arrangement according to claim 3 wherein the flame arrester component is positioned in a bypass duct selectably connected to a foreline of the vacuum pump.

9. The pumping arrangement according to claim 3 wherein the flame arrester component is positioned in a bypass duct selectably connected to an exhaust line of the vacuum pump.

10. The pumping arrangement according to claim 8 wherein a further flame arrester component is positioned in a bypass duct selectably connected to an exhaust line of the vacuum pump.

11. The pumping arrangement according to claim 1 wherein the inhibiting means is configured to supply gas to the pumping arrangement in response to the signal.

12. A pumping arrangement comprising a vacuum pump; means for supplying gas to the pumping arrangement; means for outputting a signal indicative of the onset of a combustion condition within the pumping arrangement; and control means for receiving the signal and for actuating the supply means dependant on the signal, wherein the means for outputting a signal comprises a first sensor located within a swept volume of the vacuum pump.

13. The pumping arrangement according to claim 12 wherein the means for outputting a signal comprises a second sensor located in an inlet region of the pump.

14. The pumping arrangement according to claim 12 wherein the means for outputting a signal comprises a second sensor located in an exhaust region of the pump.

15. The pumping arrangement according to claim 13 wherein the means for outputting a signal comprises a third sensor located in an exhaust region of the pump.

16. The pumping arrangement according to claim 12 wherein the first sensor is an oxygen depletion detector.

17. The pumping arrangement according to claim 16 wherein the oxygen depletion detector is an oxygen partial pressure sensor.

18. The pumping arrangement according to claim 13 wherein the means for outputting a signal comprises a detector of a flammable fluid.

19. The pumping arrangement according to claim 18 wherein the detector is one of a reactive sensor, a catalytic sensor and an infrared sensor.

20. The pumping arrangement according to claim 13 wherein the supplying means is configured to supply gas to an inlet region of the pumping arrangement.

21. The pumping arrangement according to claim 12 wherein the supplying means is configured to supply gas to a foreline attached to the pump.

22. The pumping arrangement according to claim 12 wherein the supplying means is configured to supply gas to a swept volume of the pump via gas ballast ports.

23. The pumping arrangement according to claim 12 wherein the supplying means is configured to supply gas to an exhaust region of the pumping arrangement.

24. The pumping arrangement according to claim 12 wherein the supplying means is configured to supply purge gas to the pumping arrangement.

25. The pumping arrangement according to claim 12 wherein the supplying means is configured to supply fuel gas to the pumping arrangement.

* * * * *